US007641358B1

(12) United States Patent
Smith et al.

(10) Patent No.: US 7,641,358 B1
(45) Date of Patent: Jan. 5, 2010

(54) EXPLOSION PROOF LANTERN

(75) Inventors: Mike Smith, Milford, PA (US); Randy Goodman, Petoskey, MI (US); Kevin Kelly, Hilliard, OH (US); Marty Brundage, Columbus, OH (US); Bret Kline, Columbus, OH (US)

(73) Assignee: Sunlite Safety Products, LLC, Carbondale, PA (US)

( * ) Notice: Subject to any disclaimer, the term of this patent is extended or adjusted under 35 U.S.C. 154(b) by 413 days.

(21) Appl. No.: 11/808,788

(22) Filed: Jun. 13, 2007

(51) Int. Cl.
*F21L 4/00* (2006.01)

(52) U.S. Cl. ..... 362/183; 362/192; 362/227; 362/800; 315/86; 315/307; 315/312; 320/114; 320/107

(58) Field of Classification Search ..... 362/183, 362/184, 157, 161, 192, 227, 800; 320/114, 320/107, 112, 123; 315/86, 276, 307, 312; 307/64, 66
See application file for complete search history.

(56) References Cited

U.S. PATENT DOCUMENTS

| | | | | |
|---|---|---|---|---|
| 2,665,369 | A | 1/1954 | Greppin | |
| 4,112,485 | A | 9/1978 | Sutter | |
| 4,150,302 | A * | 4/1979 | Roche | 307/66 |
| 4,156,891 | A | 5/1979 | Roche | |
| 4,360,860 | A * | 11/1982 | Johnson et al. | 362/192 |
| 4,435,744 | A | 3/1984 | Russo | |
| 5,821,695 | A | 10/1998 | Vilanilam et al. | |
| 6,851,827 | B2 * | 2/2005 | Clemente et al. | 362/158 |
| 6,917,163 | B2 | 7/2005 | Baarman | |
| 7,059,744 | B2 | 6/2006 | Sharrah | |
| 7,397,068 | B2 * | 7/2008 | Park et al. | 257/88 |
| 7,400,112 | B2 * | 7/2008 | Barbeau et al. | 320/115 |
| 2005/0099803 | A1 * | 5/2005 | Krieger | 362/183 |
| 2007/0268150 | A1 * | 11/2007 | Fraser | 340/815.63 |

* cited by examiner

*Primary Examiner*—Haissa Philogene

(57) ABSTRACT

A portable rechargeable lantern capable of use in an explosive environment includes light emitting diode light source, fault tolerant circuitry, a rechargeable battery and a charging circuit that receives power from an external charger via an induction coil. Formed within a sealed housing, the induction coil charging system eliminates external metal contacts, thereby eliminating a potential ignition source during charging operations. Fault tolerant circuitry and a cool-running light emitting diode light source eliminate potential ignition sources due to breakage or fault conditions. Mating surfaces between the lantern and its charger cradle facilitate aligning the charging induction coils.

28 Claims, 15 Drawing Sheets

| Item No. | Qty | Description |
|---|---|---|
| 1 | 1 | Lens Ring |
| 2 | 1 | Hood Expanded |
| 3 | 1 | Lens |
| 4 | 1 | LED Reflector IC, Chrome Plated |
| 5 | 1 | SL3 PCB Assembly |
| 6 | 1 | LED Heat Sink |
| 7 | 3 | Screw : Pan - M3.5 x 10.0.- Self Threading |
| 8 | 1 | Threaded Rod, M12 x 35mm, Hollow |
| 9 | 1 | Nut, M12, Self-Locking |
| 10 | 2 | Washer, M12 |
| 11 | 1 | O-Ring, 12mm ID, 1.7mm Dia. |
| 12 | 1 | Washer, Belleville, M12 |
| 13 | 1 | M12 Custom Nut |
| 14 | 1 | Wrench, Double Powder Coat, Semi-Gloss Black |
| 15 | 1 | Wrench Holddown |
| 16 | 1 | Screw : Pan - M3.0 x 8.0 |
| 17 | 1 | Len Housing |
| 18 | 1 | Front Collar |
| 19 | 3 | O-Ring, 058, Rotator |
| 20 | 1 | Rotator |
| 21 | 1 | Vent Plunger |
| 22 | 1 | O-Ring |
| 23 | 1 | Spring |
| 24 | 1 | Screw : Pan - M2.5 x 8.0 |
| 25 | 1 | Washer : Plain - M2.0 x 0.75 |
| 26 | 1 | Connector, Female |
| 27 | 2 | M5-.8*10 Truss Head Shoulder Screw - Self Threading |
| 28 | 2 | Trigger Roller Washer |
| 29 | 2 | Pin : Spring - M2.0 x 14.0 |
| 30 | 1 | Trigger Coil Spring |
| 31 | 1 | Trigger |
| 32 | 1 | Gasket |
| 33 | 1 | Screw : Pan - M2.3 x 10.0 |
| 34 | 1 | Switch, Wire Assembly |
| 35 | 1 | Grip Front Overmold |
| 36 | 1 | Grip Backup Front |
| 37 | 1 | Tongue |
| 38 | 2 | Rod, Polished, 4mm |
| 39 | 1 | Thermistor |
| 40 | 1 | Lantern Body-Battery Assembly, NiMH, C1D1 |
| 41 | 5 | Battery, NiMH, Tenergy 90F-1100 |
| 42 | 4 | Battery Contact, Straight |
| 43 | 4 | Insulation, Battery Contact |
| 44 | 1 | Wire Assembly, Battery Black |
| 45 | 1 | Wire Assembly, Battery Black |
| 46 | 1 | Grip Backup Back |
| 47 | 1 | Grip Back Overmold |
| 48 | 4 | Screw : Pan - M6.0 x 160.0 - Self Threading |
| 49 | 1 | Washer : Plain - M3.5 x 1.2 |
| 50 | 1 | Screw, ST4.3x45mm, Phillips Pan Head, SS Threading |
| 51 | 1 | PCB |
| 52 | 1 | Tapered Wire Coil, 16617 |
| 53 | 1 | Shrink Wrap |
| 54 | 1 | End Cap Lens |
| 55 | 1 | O-Ring AS-568B-159 |
| 56 | 1 | Rear Collar |
| 57 | 1 | Connector, Female, Wire Harness |
| 58 | 4 | Wire Tie, Small, Nylon |
| 59 | 1 | Grease |
| 60 | 1 | Loctite 262, High Strength |
| 61 | 1 | Superglue |

FIG. 11A

| Item No. | Qty | Description |
|---|---|---|
| 1 | 1 | Lens Ring |
| 2 | 1 | Hood Expanded |
| 3 | 1 | Lens |
| 4 | 1 | LED Reflector IC, Chrome Plated |
| 5 | 1 | SL3 PCB Assembly |
| 6 | 1 | LED Heat Sink |
| 7 | 3 | Screw : Pan - M3.5 x 10.0 - Self Threading |
| 8 | 1 | Wire Harness, LED (4 Conductor) |
| 9 | 1 | Threaded Rod, M12 x 35mm, Hollow |
| 10 | 1 | Nut, M12, Self-Locking |
| 11 | 1 | Washer, M12 |
| 12 | 1 | O-Ring, 12mm ID, 1.7mm Dia. |
| 13 | 1 | Washer, Belleville, M12 |
| 14 | 1 | M12 Custom Nut |
| 15 | 1 | Wrench, Double Powder Coat, Semi-Gloss Black |
| 16 | 1 | Wrench Holddown |
| 17 | 1 | Screw : Pan - M3.0 x 8.0 |
| 18 | 1 | Len Housing |
| 19 | 1 | Front Collar |
| 20 | 3 | O-Ring, 058, Rotator |
| 21 | 1 | Rotator |
| 22 | 1 | Vent Plunger |
| 23 | 1 | O-Ring |
| 24 | 1 | Spring |
| 25 | 1 | Screw : Pan - M2.5 x 8.0 |
| 26 | 1 | Washer : Plain - M2.0 x 0.75 |
| 27 | 1 | Connector, Female |
| 28 | 7 | Battery, NiMH, Tenergy 90F-1100 |
| 29 | 2 | M5-.8*10 Truss Head Shoulder Screw - Self Threading |
| 30 | 2 | Trigger Roller Washer |
| 31 | 2 | Pin : Spring - M2.0 x 14.0 |
| 32 | 1 | Trigger Coil Spring |
| 33 | 1 | Trigger |
| 34 | 1 | Gasket |
| 35 | 1 | Screw : Pan - M2.3 x 10.0 |
| 36 | 1 | Switch, Wire Assembly |
| 37 | 1 | Grip Front Overmold |
| 38 | 1 | Grip Backup Front |
| 39 | 1 | Tongue |
| 40 | 2 | Rod, Polished, 4mm |
| 41 | 1 | Thermistor |
| 42 | 1 | Lantern Body-Battery Assembly, NiMH, C1D1 |
| 43 | 2 | Battery Contact, Straight |
| 44 | 1 | Grip Backup Back |
| 45 | 1 | Grip Back Overmold |
| 46 | 2 | Screw : Pan - M6.0 x 160.0 - Self Threading |
| 47 | 1 | Washer : Plain - M3.5 x 1.2 |
| 48 | 1 | Screw, ST4.3x45mm, Phillips Pan Head, SS Threading |
| 49 | 1 | PCB |
| 50 | 1 | Tapered Wire Coil, 16617 |
| 51 | 1 | Shrink Wrap |
| 52 | 1 | Sealing Assembly-159 |

FIG. 12A

EXPLOSION PROOF LANTERN

FIELD OF THE INVENTION

The present invention generally relates to explosion proof lighting equipment, and more particularly to a rechargeable portable lantern suitable for use in all explosive environments.

BACKGROUND OF THE INVENTION

Several occupations require the use of a portable lantern. However, in a wide variety of hazardous environments conventional lanterns are unusable. The Occupational Safety and Health Administration (OSHA) has classified a number of hazardous work environments where special precaution must be taken to provide workers with safe working conditions. The most extreme work environment is classified as Class I, Division 1. A Class I, Division I work environment is a location in which: (a) hazardous concentrations of flammable gases or vapors may exist under normal operating conditions; or (b) hazardous concentrations of such gases or vapors may exist frequently because of repair or maintenance operations or because of leakage; or (c) breakdown or faulty operation of equipment or processes might release hazardous concentrations of flammable gases or vapors, and might also cause simultaneous failure of electric equipment.

Examples of work locations where Class I, Division I classifications are typically assigned include: locations where volatile flammable liquids or liquefied flammable gases are transferred from one container to another; interiors of spray booths and areas in the vicinity of spraying and painting operations where volatile flammable solvents are used; locations containing open tanks or vats of volatile flammable liquids; drying rooms or compartments for the evaporation of flammable solvents; locations containing fat and oil extraction equipment using volatile flammable solvents; portions of cleaning and dyeing plants where flammable liquids are used; gas generator rooms and other portions of gas manufacturing plants where flammable gas may escape; inadequately ventilated pump rooms for flammable gas or for volatile flammable liquids; the interiors of refrigerators and freezers in which volatile flammable materials are stored in open, lightly stoppered, or easily ruptured containers; and all other locations where ignitable concentrations of flammable vapors or gases are likely to occur in the course of normal operations.

Given the high volatility present in these types of working environments, conventional lanterns cannot be safely used since their electrical connections to batteries, hot filaments, exposed metal connections and unsealed switches could cause sparks. Thus, a need exists for a rechargeable portable lantern which can operate in such dangerous environments.

SUMMARY OF INVENTION

The present invention provides a portable explosion proof lantern with fault proof electronic circuitry that can be used in all explosive environments that may be encountered, not just limited to certain explosive environments. Various embodiments of the present invention provide inductively rechargeable batteries for powering the device, obviating the need for disposable batteries. Further embodiments include a portable lantern with a pivoting rotating head with a multiple LED light packaged within an unbreakable explosion proof lantern body. Other embodiments provide a portable easy to use lantern for the hazardous environments that does not require an external power supply or require extension cords for the power that is more cost effective, durable and easier to use.

BRIEF DESCRIPTION OF THE DRAWINGS

The accompanying drawings, which are incorporated herein and constitute part of this specification, illustrate embodiments of the invention, and, together with the general description given above and the detailed description given below, serve to explain features of the invention.

FIGS. 11A and 11B provide an exploded view of another form of the lantern along with a listing of the elements included therewith.

FIGS. 12A and 12B provide an exploded view of another form of the lantern along with a listing of the elements included therewith.

DETAILED DESCRIPTION OF THE PREFERRED EMBODIMENT

Figure 1A:
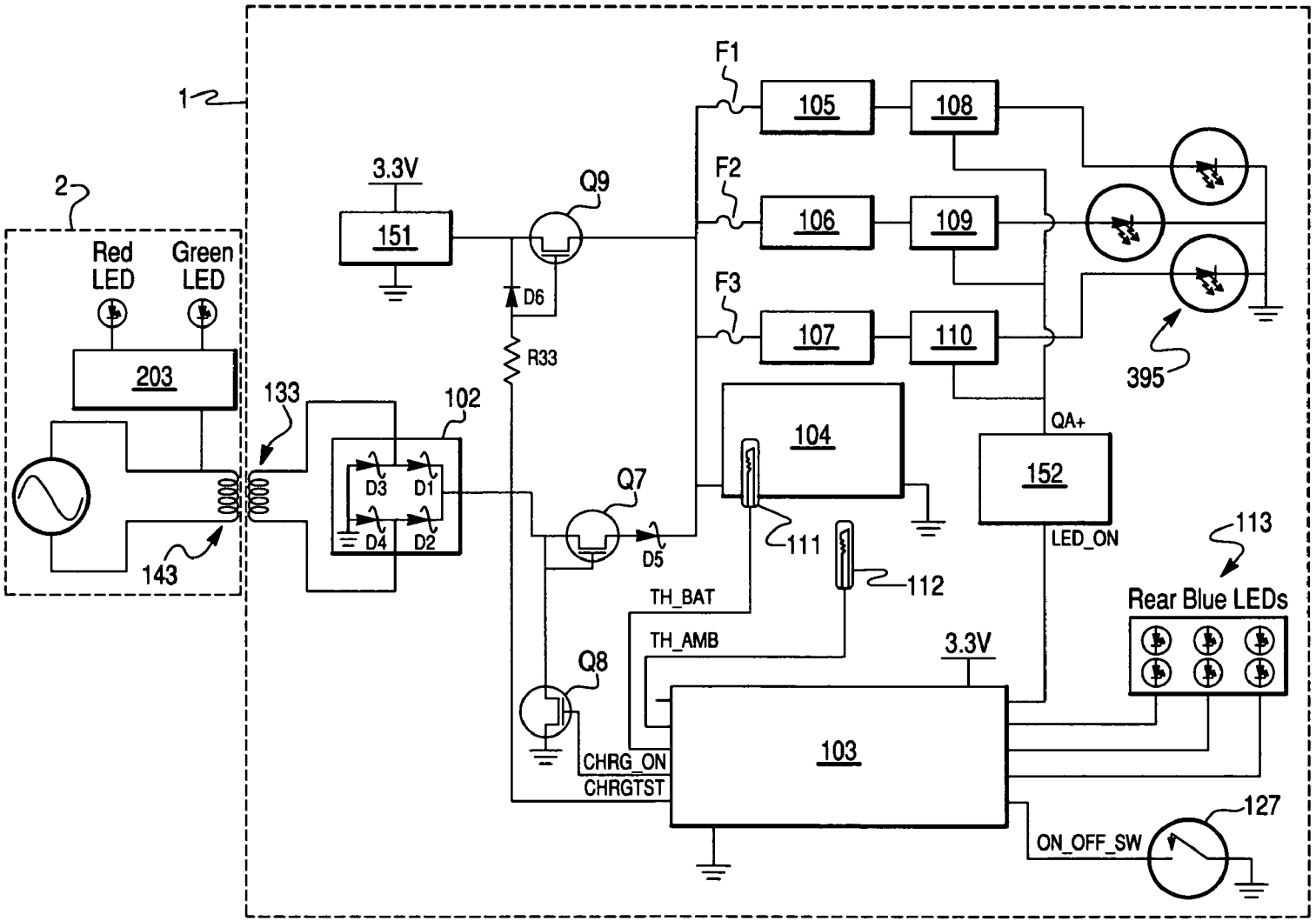
FIG. 1*a* is a simplified schematic illustrating the electrical configuration of an embodiment of the lantern.

The various embodiments will be described in detail with reference to the accompanying drawings. Wherever possible, the same reference numbers will be used throughout the drawings to refer to the same or like parts.

As used herein, the terms "about" or "approximately" for any numerical values or ranges indicates a suitable dimensional tolerance that allows the part or collection of components to function for its intended purpose as described herein. As used herein, the terms "high voltage," "high signal," "low voltage" and "low signal" refer to voltage levels corresponding to "1" or "0" in a digital logic circuit, such as a microcontroller.

OSHA has mandated that the only lantern than can be used in Class 1 Division 1 environments is a Class 1 Division 1 rated intrinsically safe light. Currently, there is no portable rechargeable lantern available in the world with this rating. The only lanterns available today for use in Class 1, Division 1 environments are lights with external power sources that must use electrical cords, or small hand held flashlights with disposable batteries.

Conventional lanterns fail to meet all of the needs of an ideal lantern for use in Class 1, Division 1 environments.

Most conventional lanterns do not have explosion proof electronic circuitry and as a result may cause explosions in some hazardous environments. Such lanterns can only be rated for certain environments but not others. Other conventional lanterns are not portable, requiring external power sources and cumbersome extension cords. Conventional rechargeable lanterns have some exposed metal components, particularly metal contacts for connecting to recharging power sources. Conventional lanterns which do not have such exposed metal contacts are not rechargeable, and consequently require purchase of replacement batteries on a regular basis at a significant cost along and with the environmental problem of disposing of the depleted batteries. Lastly, many conventional lanterns for hazardous environment applications are difficult to manufacture.

To overcome the limitations of conventional lanterns, the various embodiments of the present invention feature an intrinsically explosion proof rated portable rechargeable lantern that allows recharging of an internal rechargeable battery, such as a nickel metal hydride battery, without the need for exposed metal contacts. The various embodiments include electronic circuitry that will prevent a fault condition from causing an explosion even when directly exposed to explosive gases. Further, the various embodiment use cool-running light emitting diodes (LED) instead of conventional halogen or incandescent bulbs which operate at temperatures high enough to cause an explosion if exposed to flammable vapors (such as when a bulb breaks). These electrical features are packaged in a rugged sealed housing that is designed to reliably mate with a charging stand. No known portable explosion proof intrinsically rated lantern provides these features.

As used herein, the term explosion proof intrinsic rating means that the electrical apparatus employs circuits that are not capable of causing ignition in all hazardous locations as defined in Articles 500 and 505 in the National Electrical Code, ANSI/NFPA 70 or in Division 1 hazardous (classified) locations as defined in the Canadian Electrical Code, Part 1, C22.1. To comply with such stringent requirements, a lantern must not include any circuitry which could result in an ignition source due to a fault in a circuit, breakage of any part of the lantern such as the light bulb, or arc between power sources (e.g., batteries) and lantern circuitry.

To comply with these stringent requirements, the various embodiments utilize fault tolerant circuitry, light emitting diodes (LED) instead of halogen or incandescent bulbs, and self-contained rechargeable batteries coupled to an induction charging circuit. The result is a lantern design which has addressed potential sources for ignition, such as electrical fault conditions, broken bulbs, or arcing to exposed metallic conductors. In contrast, conventional lanterns to not feature fault tolerant circuitry and typically use halogen or incandescent bulbs. Thus, when a conventional lantern fails or is dropped, an ignition source may be provided by the high temperature from a short circuit or in the light bulb filament when a bulb breaks.

Another problem with some conventional lanterns is that they have exposed metal or conductive components which are used to connect batteries to an external power source for charging purposes. The various embodiments of the present invention do not have exposed metal parts, especially no conductive metal contacts, that may cause sparking (which could provide an ignition source) if contacted by an external conductive material. To eliminate exposed metal contacts while still providing the capability of rechargeability, embodiments utilize induction charging circuitry to provide charging power to a self-contained rechargeable battery assembly within the lantern. In addition, the use of induction charging allows the unit to be totally sealed. Consequently, the various embodiments to not have any gaps or seams which would be necessary to allow for exposed metallic contacts. As an additional benefit, the use of induction charging provides a more reliable means of recharging, because metallic contacts tend to corrode.

Figure 1B:
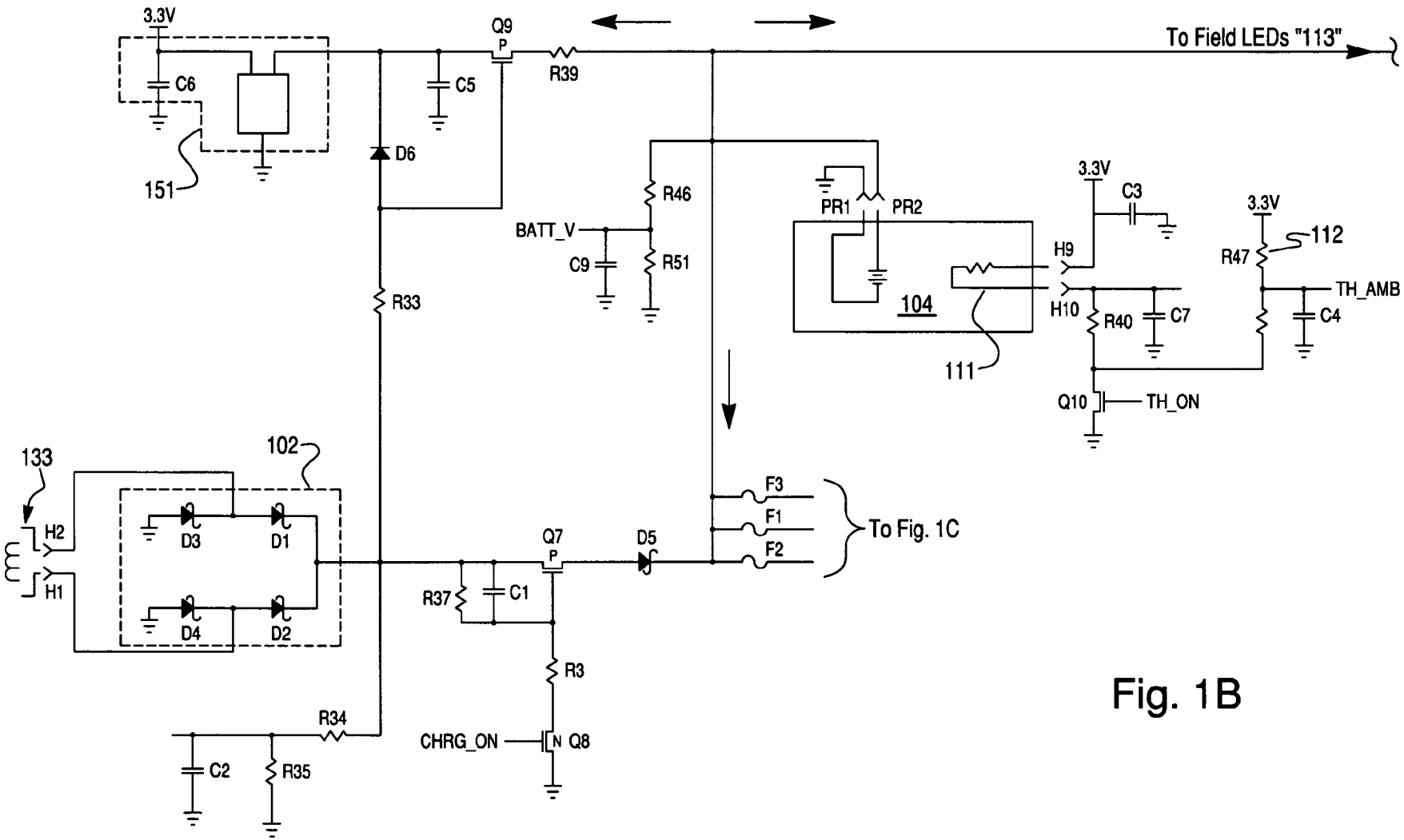
FIGS. 1*b*-1*f* are detailed electrical schematics illustrating circuit elements of the embodiment shown in FIG. 1*a*.

Elements and basic operation of the circuitry of an example embodiment are now described with reference to FIG. 1*a*, which is a schematic illustrating the electrical circuit diagram of an embodiment, and FIGS. 1*b*-1*f*, which are detailed schematics showing circuit elements suitable for the implementing the embodiment shown in FIG. 1*a*. Referring to FIG. 1*a*, charging power is received by the lantern 1 from a charger cradle 2 via charging secondary coil 133. FIG. 1*b* shows the connection solder holes H2 and H1 provided in a printed circuit board into which the charging secondary coil 133 is soldered. When the lantern 1 body is placed in the charging cradle 2, the secondary coil 133 is positioned in close proximity with the primary coil 143 within the charging post 145 (shown in FIG. 4) on the charging cradle 2. As alternating current flows through the primary coil 143 of the charging cradle 2, an AC voltage is induced in the secondary coil 133. This induced AC voltage in the secondary coil 133 is full wave rectified within the lantern by a full wave rectifier bridge 102, which outputs a DC voltage. In the embodiment illustrated in FIGS. 1*a* and 1*b*, the full wave rectifier bridge 102 is made up of diodes D1, D2, D3, D4. The output of the full wave rectifier bridge 102 is connected to three connections which lead to microcontroller input CHRGTST (charge test) via resistor R34 (shown in FIG. 1*b*), transistor Q7, and resistor R33.

As shown in FIGS. 1*a* and 1*b*, an output of the full wave rectifier bridge 102 is connected to the microcontroller 103 as input CHRGTST. The CHRGTST input is used by the microcontroller to determine which lantern operating states should be activated. Specifically, the microcontroller 103 uses the voltage of the CHRGTST input signal to determine if the lantern unit is receiving charging energy (i.e., the lantern 1 is positioned on the charging cradle 2 which is energized). Inputs and outputs of the microcontroller 103 are shown in more detail in FIG. 1*e*. If the secondary coil 133 is receiving charging energy, a high voltage will appear at the output of the full wave rectifier bridge 102 which will cause a high voltage to appear across resistors R34 and R35 (see FIG. 1*b*) and thus, a high voltage will be provided on the CHRGTST input to the microcontroller 103. A high signal on the CHRGTST input indicates to the microcontroller 103 that the lantern 1 is positioned on the charger cradle 2 and the charger cradle power supply is energized, and a DC voltage is being output from the full wave rectifier bridge 102. At other times when the lantern 1 is not positioned on the charger cradle 2 (or the charger cradle power supply is not energized), no voltage or low voltage is output from the full wave rectifier bridge 102, which will result in either no voltage or low voltage across resistor R34 and R35 resulting in a low signal on the CHRGTST input. Thus, a no or low signal on the CHRGTST input indicates to the microcontroller 103 that the charger cradle 2 is disengaged (or unpowered) and, thus, the lantern is operating solely on battery power.

When the microcontroller 103 detects that the charger cradle 2 is engaged via a high voltage on input CHRGTST, a high signal is output from the microcontroller on lead CHRG_ON. Referring to FIGS. 1*a* and 1*b*, the microcontroller 103 outputs a high signal on CHRG_ON which switches on the normally-off transistor Q8, which switches on transistor Q7 by pulling its gate below its source (p-channel MOSFET). Turning on transistor Q7 allows charging current from the full wave rectifier bridge 102 output to flow through diode D5 to the battery 104. When the CHRG_ON output is low, transistor Q7 is turned off (by Q8 turning off and allowing equalization of the p-channel MOSFETS gate and source voltages) and current from the full wave rectifier bridge 102 is inhibited from entering the battery 104.

Resistor R33 is also connected to the output of the full wave rectifier bridge 102. In a condition where the charge in the battery 104 has been depleted, a voltage will appear across resistor R33 when the output of the full wave rectifier bridge 102 provides DC voltage (i.e., when the secondary coil 133 comes into close proximity with the primary coil 143 of the charge cradle 2). The voltage across resistor R33 turns on transistor Q9 which enables a low impedance path between the battery 104 and the regulator 151. The regulator 151 is a voltage regulator with a low quiescent current (meaning that it does not waste much current) and a high voltage rating. The regulator 151 must be able to handle the highest charging voltage. To accommodate an abnormal situation in which the charger is on but transistor Q7 is in the "off" state, this voltage rating should be at least about 18v. The output from the voltage regulator 151 is used to power the microcontroller 103. When the microcontroller 103 is powered and functioning, transistors Q8 and Q7 can be activated as described above in to allow the flow of current to charge the batteries. Q9 is a P-channel MOSFET. Pin2 is the source, Pin1 is the gate, Pin3 is the drain. The threshold voltage (Vth) is the voltage necessary to turn on the device. When the gate of Q9 is pulled Vth below the source of Q9, Q9 turns on and shorts the drain to the source. If the lantern is not docked in its charger, then the gate of Q9 is pulled down by R33, R34, R35 and is thus in an on state. If the lantern is docked in the charger, then the gate of Q9 is held one diode drop above the source by D6 and Q9 is off preventing current from passing from the drain to the source.

The importance of Q9, R33 and D6 are realized when you consider what happens when these elements are not present in the circuit and the battery is extremely low. If the battery is extremely low when the lantern is put on the charger the micro may not have sufficient voltage to turn on transistor Q7. If transistor Q7 is unable to turn on, the charging of the battery will not commence. In fact, if the voltage level of the battery runs out to an exceedingly low level the micro may not operate properly. In such a situation, without transistor Q9, resistor R33 and diode D6, the lantern would not be able to recover from the low battery level and operate the voltage regulator U1

Figure 1C:
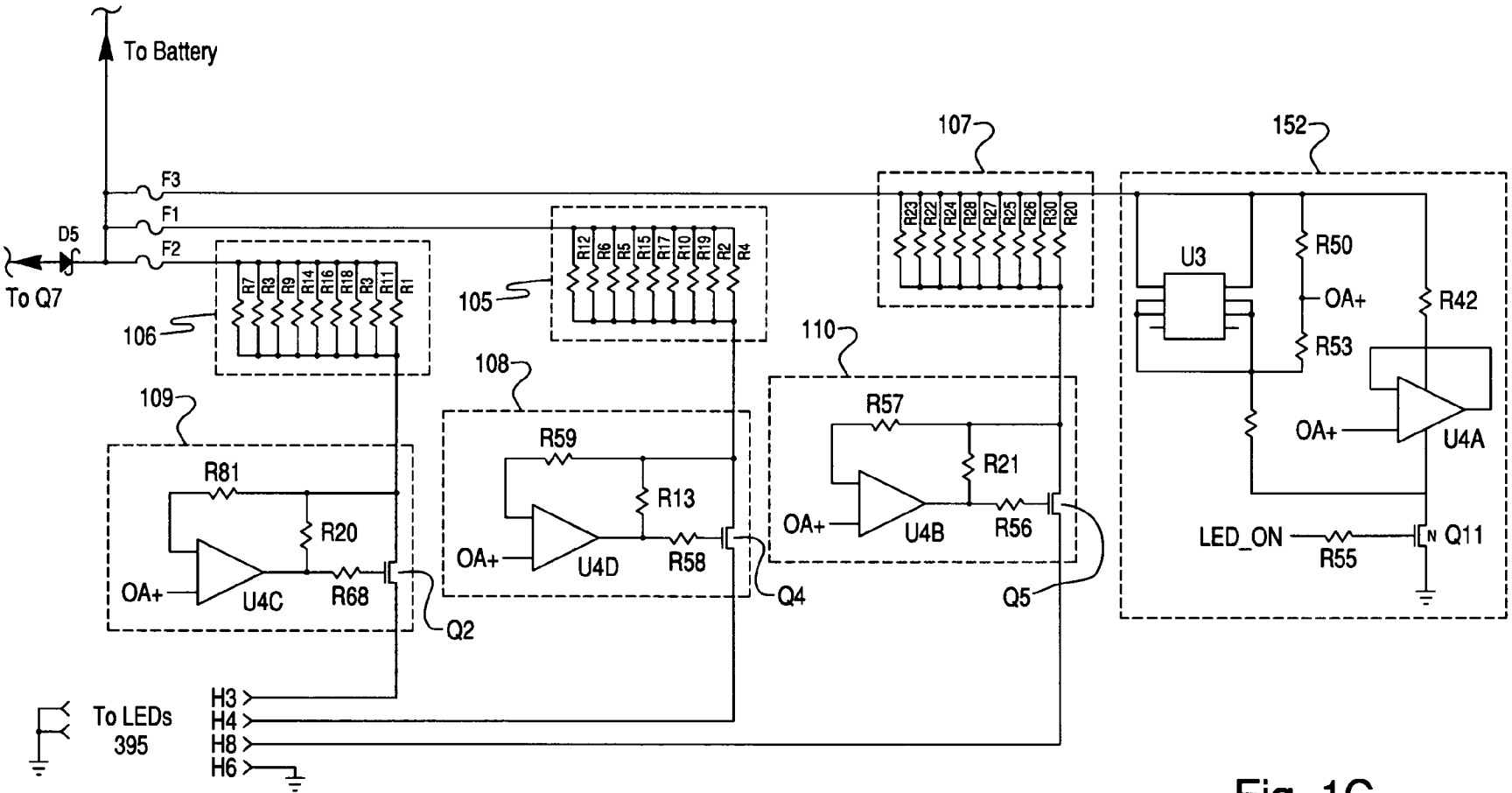
Figure 1D:
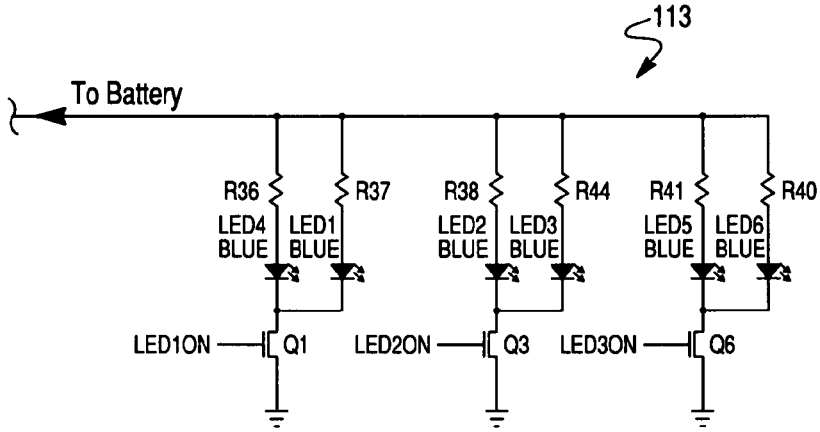
Figure 1E:
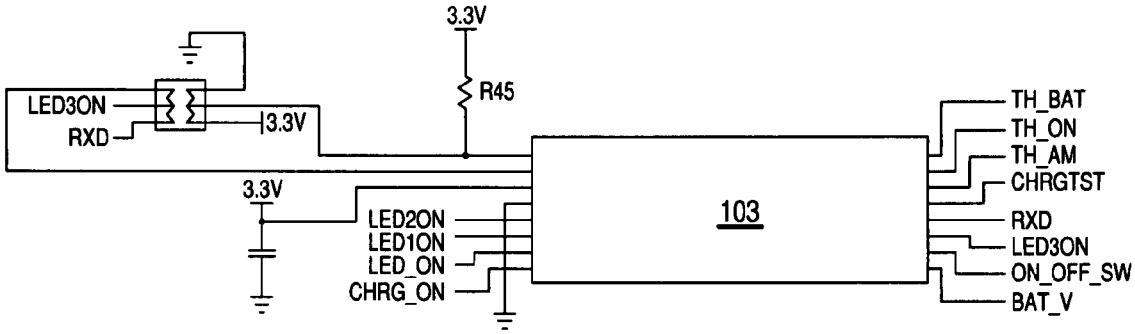

In the embodiment shown in FIG. 1*a* and 1*e*, the microcontroller 103 is a low power, low voltage 8 bit 8K flash microprocessor with a 10-bit analog-to-digital converter. However, any number of other microprocessors may be used as will be appreciated by one of skill in the art.

Figure 1F:
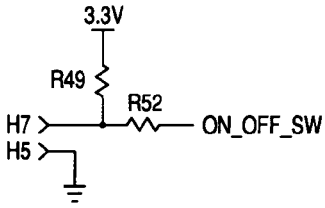

An on-off switch 127 is electrically connected to the microprocessor 103 to permit a user to turn the lantern 1 on and off. As illustrated in FIG. 1*f*, a conventional switch (e.g., a push button switch as described in more detail herein) can be connected to a printed circuit board by soldering the switch wires into solder holes H5 and H7. The on or off position of the switch 127 is communicated to the microprocessor 103 via input ON_OFF_SW. In operation, if the lantern 1 is off and the switch 127 is pushed in and held, the microprocessor 103 receives a signal on the ON_OFF_SW input and activates the main illumination LEDs 395, and initiates a series of on/off patterns of blue LEDs 113 positioned on the back or rear of the lantern 1. The microcontroller turns on the main illumination LEDs 395 by sending a signal (e.g., a high signal) on output LED_ON which is connected to the gate of transistor Q11 which activates precision voltage reference 152 (described below) which activates the constant current sources 108, 109 and 110 (described below) which power the main illumination LEDs 395. In the embodiment illustrated in FIG. 1*a*, there are six blue LEDs 113 positioned on the rear of the lantern 1. These blue LEDs are identified as LED1 BLUE, LED2 BLUE, LED3 BLUE, LED4 BLUE, LED5 BLUE and LED6 BLUE in FIG. 1*d* which shows details of implementing circuitry. Referring to FIG. 1*d* and 1*e*, the microcontroller 103 controls the on/off status of the rear blue LEDs to generate their on/off patterns via outputs LED1ON, LED2ON and LED3ON which connect to gates of transistors Q1, Q3 and Q6, respectively. The user selects a particular pattern by letting up on the switch 127 when the desired LED pattern is active. In particular, these patterns might include: all on, all off, blinking, rotating, or an SOS blinking pattern.

Also shown in the schematic in FIGS. 1*a* and 1*b*, diode D5 has an input connected to the output of the "charge on" transistor Q7 and an output connected to three fuses F1, F2, F3. Diode D5 is present to satisfy the requirements of UL913 which states in section 8.1.2.1 that "intrinsically safe circuits in electrical apparatus and systems of category 'ia' shall be incapable of causing ignition with the following: a) no faults and the most unfavorable normal operating conditions; b) the most unfavorable single fault and any subsequent related defects and breakdown; c) the most unfavorable combination of two faults and any subsequent related defects and breakdown." Specifically, three diodes are needed between the battery and ground because the printed circuit board needs to be able to survive two faults without generating an ignition source. In the circuit embodiment illustrated in FIGS. 1*a*-1*f*, if two diodes fail, there is still a third diode to prevent shorting the battery to ground. By incorporating diode D5 with the diode bridge the circuit is provided with three redundant fault elements. In this way the circuit can withstand two faults through two diodes of the diode bridge as well as through D5. For example, the circuit could withstand a fault on D1 and D5 and still have at least one diode (D3 or D4) between the battery and ground.

Referring to FIGS. 1*a* and 1*c*, the three fuses F1, F2, F3 supply battery current to three respective resistor arrays 105, 106, 107. These fuses protect the resistor arrays from a fault current from the battery and thus allow the power dissipation rating of the resistor arrays to be greatly reduced. This reduced power dissipation is necessary to meet the intrinsically rated lantern requirement. In addition, by reducing the power dissipation rating of the resistor arrays, the resistors making up the resistor arrays can be smaller and less expensive. Moreover, each resistor within the resistor arrays can serve two functions. First, each resistor limits the output fault current to a value lower than the maximum determined by spark testing ×⅔. Intrinsically safe circuits are energy limited. In other words, they lack the energy to promote ignition. Spark ignition tests are performed to determine maximum allowed current to prevent the ignition. For example, if the maximum allowed current is 8 amps, Underwriter Laboratories (UL) standards require this value be derated by ⅔ (0.666666). Consequently, the current must be limited to ⅔ (8 amps) or 5.3 amps to be rated intrinsically safe by UL. The current must be limited with two faults to less than 5.3 amps. Second, the resistors serve as sense resistors for the OPAMP/MOSFET constant current source circuits 108, 109 and 110 formed by circuit elements U4C/Q2, U4D/Q4, and U4B/Q5 illustrated in FIG. 1*c*. Each of these three current sources provide 350 ma to one of the three K2 power LEDs 395, thereby providing the power to generate light using cool LED light sources. The connections between the constant current source circuits 108, 109 and 110 and the LEDs 395 is shown in FIG. 1*c* as solder connections H3, H4, H8, H6 into which the electrical leads from the LEDs 395 would be soldered.

Referring to FIGS. 1*a* and 1*c*, a precision voltage reference circuit 152 produces a precise voltage QA+ that is provided as the positive node input to the OPAMP/MOSFET of each of the constant current source circuits 108, 109 and 110. The precision voltage reference circuit 152 is activated by the microcontroller 103 outputting a high signal on output LED_ON. Specifically, as shown in FIG. 1*c*, when the microcontroller provides a high signal on output LED_ON, transistor Q11 is switched on which provides a current path to ground for the precision voltage reference 152, in particular, circuit elements U3 and U4. Once the precision voltage reference circuit 152 is energized, its output QA+ is provided to the constant current source circuits 108, 109 and 110. Thus, the constant current source circuits 108, 109 and 110 are turned on when transistor Q11 is switched on by the high signal on output LED_ON, thus powering the LEDs 395.

Referring to FIGS. 1*a* and 1*b*, the battery 104 comprises one or more rechargeable batteries in a battery pack or assembly. In the preferred embodiment, the battery 104 is made up of five NiMH cells wired in series. Suitable NiMH battery cells include the Tenergy TEN-90F13000 battery cell used in the preferred embodiment. Such cells have a nominal voltage of 1.2V with a typical capacity of 13000 mAh.

As the lantern battery 104 charges, the relative voltage level and the temperature of the battery 104 must be monitored in order to prevent overheating and breakdown of the battery cells. As NiMH batteries charge, the temperature of the cells increases at a rate that depends upon the charge condition of the cells. At some point in the charging cycle near maximum charge capacity the rate of temperature rise increases dramatically as the chemical reaction in the cells becomes exothermic. To prevent heat induced damage to the battery cells, the embodiment illustrated in FIGS. 1*a* and 1*b* includes a first thermistor 111 thermally connected to the battery and electrically connected to the microprocessor 103 along with circuits to prevent further charging of the battery cells when the rate of temperature increase indicates a fully charged state, or the battery temperature exceeds a safe value.

The first thermistor 111 positioned in the battery pack to monitor battery temperature generates a voltage across the capacitor C7 (shown in FIG. 1*b*) indicative of the battery temperature. This voltage value is inputted to the microcontroller 103 through the input lead TH_BAT. A second thermistor 112 mounted on the printed circuit board is used to monitor ambient temperature and provide an offset for the ambient environmental influence on battery temperature. Similarly, the printed circuit board mounted thermistor 112 provides a voltage charge across the capacitor C4 indicative of the ambient temperature. This voltage value is inputted to the microcontroller 103 through input lead TH_AMB. To conserve battery power, the microcontroller 103 initiates temperature readings when necessary (such as when the CHRGTST is high) by outputting a high voltage on output TH_ON (shown in FIG. 1*b*), which turns on transistor Q10 to connect the thermistors 111, 112 to ground.

These temperature readings are important because NiMH batteries require use of a dT/dt (i.e., rate of change of temperature versus time) method for determining when a fully charge state exists and charging should be terminated. The battery and ambient thermistors 111, 112 provide signals that allow the microcontroller 103 to determine the point at which the charging chemical reactions reach the exothermic state and to terminate further charging based on that determination. When graphed along the x/y axis with temperature of the battery cell along the y-axis and time along the x-axis, a change in the slope of the graph of dT/dt can be identified by an inflection point, called a "knee" in the dT/dt curve. A program operating in the microcontroller 103 includes a "charge termination algorithm." This algorithm detects such a change in the rate of battery pack temperature rise and terminates the charge operation (by driving CHRG_ON to low voltage turning transistor Q7 off) to prevent overheating and damage to the battery cells.

The microcontroller 103 terminates the battery charging process by driving output CHRG_ON to low, which turns off transistor Q8 on, thereby allowing the gate of transistor Q7 to reach the same voltage level as the source, thereby turning transistor Q7 off, which disconnects the full wave bridge 102 from the battery 104.

After the battery is fully charged the microcontroller 103 begins trickle charging operations by switching transistor Q7 on (by driving output CHRG_ON high) for short durations resulting in short, periodic charging pulses supplied to the battery 104.

The microcontroller 103 also monitors the battery temperature indicated by the thermistor 111 to terminate charging operations if the battery temperature exceeds a safe limit. By way of example, this determination can be based upon a simple comparison of the value of TH_BAT (or the difference between TH_BAT and TH_AMB) to a value stored in memory. Preferably, the charge operation will terminate if the battery reaches 55 degrees Celsius.

The microprocessor 103 may also terminate the battery charging process based on the total charge time. Preferably, the charge operation will terminate if the total charge time reaches 18 hours.

Referring to FIG. 1*b*, a battery voltage measurement circuit, comprising two resistors R46 and R51 and a capacitor C9, is provided to measure the voltage across the battery. The measured voltage is inputted to the microcontroller 103 through input lead BATT_V. In instances where the battery 104 has not been fully depleted when the lantern 1 is placed in the charging cradle 2, the battery temperature may not increase significantly despite a full charge condition. To manage the charging process in such instances, the microcontroller 103 can terminate the charging operation when a specified voltage is measured across the battery cells. By way of example, this determination may be made by comparing the BATT_V input to a value stored in memory.

Figure 2:
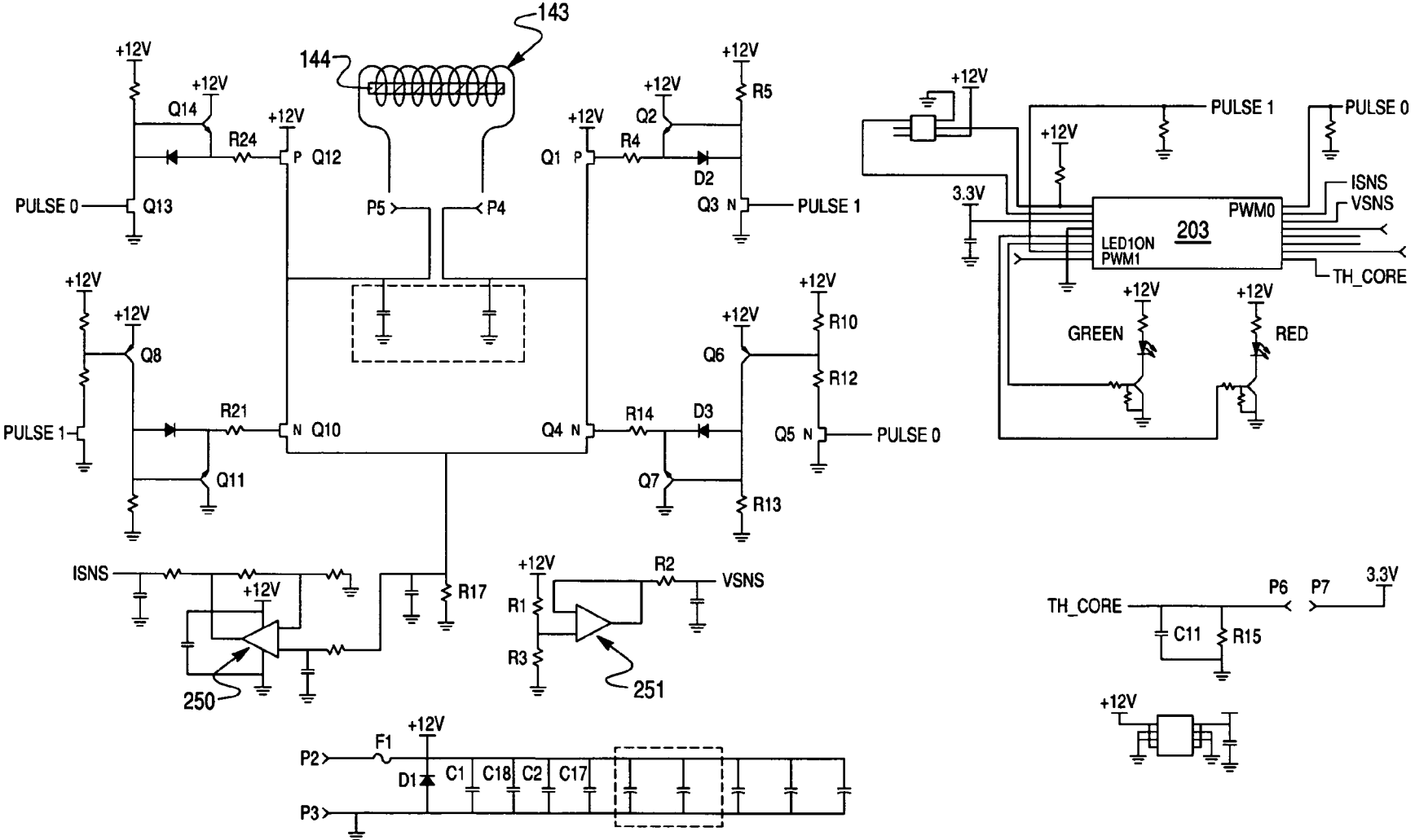
FIG. 2 is a schematic illustrating the electrical configuration of an embodiment of the charging cradle.

FIG. 2 illustrates an embodiment of the charge cradle 2 electrical circuits. These circuits receive power from an external power source and provide an alternating current to the primary coil (not shown in FIG. 2) that generates the alternating magnetic field that induces current in the secondary coil 122 in the lantern 133. At the core of the charging cradle circuit is the transistor H-bridge formed by Q1, Q4, Q10, and Q12. The transistors are turned on in pairs. Transistors Q4 and Q12 are turned on by signal PULSE0 while transistors Q1 and Q10 are turned on by signal PULSE1. The primary coil is connected to holes P4 and P5. When transistors Q4 and Q12 are turned on, the current goes from left to right (as you view it in FIG. 2). In contrast, when transistors Q1 and Q10 are turned on, the current goes from right to left (as you view it in FIG. 2). The alternating current produces an alternating magnetic field which is amplified by the magnetic core material. The alternating magnetic field may be driven at a frequency of approximately 20 kHz. The transistor H-bridge is driven by the PWM output of microcontroller U2. The timing of the output signal purposefully prevents transistors Q1 and Q4, or Q10 and Q12 from being on at the same time. Thus, preventing power supply shorting and/or the instance where the alternating magnetic field would be negated.

The circuits driving transistors Q4 and Q10 are identical. As shown in FIG. 2, transistor Q4 has resistor R14 connected to the gate. Resistor R14 is added to limit the ringing of the Q4 gate capacitance in combination with the parasitic inductance of the traces. Transistor Q7, resistor R13 and diode D3 serve to speed the turn off of Q4 without slowing the turn on operation. Transistor Q6 is a PNP transistor used to provide the gate drive to Q4. A high logic level on Q5 turns it on, shorting the drain to source which is at ground. This in turn pulls down R12 and the base of Q6, consequently turning on transistor Q6. This in turn turns on transistor Q4. An analogous operation of elements drives transistor Q10. As above, the timing of the operation of transistors Q4 and Q10 are synched out of phase through alternating high levels on PULSE0 and PULSE1 from the microcontroller U2.

The circuits driving transistors Q1 and Q12 are also identical. As shown in FIG. 2, transistor Q1, which is a P-channel MOSFET, has resistor R4 connected to the gate. As with resistor R14 above, resistor R4 is added to dissipate any gate ringing. Similarly, transistor Q2, resistor R5, and diode D2 serve to speed up the turn off of Q1 (which is due to the fact that it is a p-channel MOSFET and is achieved by raising the gate up to the same voltage as the source node (+12v)). An analogous operation of elements drives transistor Q12. As above, the timing of the operation of transistors Q1 and Q12 are synched out of phase through alternating high levels on PULSE0 and PULSE1 from the microcontroller U2.

When the lantern 1 is placed on the charging cradle 2 and battery charging begins (as described above), the interaction of the alternating magnetic field generated by the primary coil with the secondary coil 133 causes an increase in current through primary coil. When this happens, the microcontroller 203 in the charger cradle 2 (FIG. 2) detects the increased current in the primary coil and turns on a red LED D5 on the cradle to indicate that the lantern battery is being charged. The microcontroller 203 turns on the red LED D5 by driving output LED2ON (87/SCL/EXTAL) to high voltage.

Referring back to FIG. 2, resistor R17 is used to bridge current into a voltage which is then filtered and amplified by operational amplifier 250 and presented to the microcontroller U2 as signal ISNS. Operational amplifier 251 is used to buffer the voltage from the resistive divider composed of resistor R1 and R3. This signal is then filtered and presented to the microcontroller as signal VSNS which is representative of the supply voltage.

The charging cradle circuitry is further provided with a temperature thermistor which allows the charging circuit to modify the charging cycle and consequently the core temperature of the charging core. In instances of hot ambient environments, the microcontroller may drive the h-bridge in such a way that the temperature of the core becomes excessive. A thermistor formed by resistor R15 and capacitor C11 is added so that the microcontroller can take the core temperature into consideration as it drives the H-bridge. The thermistor is connected to holes P6 and P7. The resulting signal is filtered and presented to the microcontroller input line at TH_CORE. In order to support widely varying input voltages, the microcontroller is programmed with a constant power algorithm. The duty cycle is modified to control the power into the primary and consequently the power in to the secondary coil of the lantern. The constant power algorithm is useful for preventing the core from experiencing excessive temperature which can result in a breakdown of components.

When the lantern microcontroller 103 initiates trickle charging operations as described above, the brief periodic charging pulses to the battery 104 induce brief periodic increases in current in the primary coil of the charger cradle 2. The microcontroller 203 in the charger cradle 2 detects such intermittent changes in the charge current and in response turns on the green LED positioned on the cradle to indicate that the lantern battery is fully charged and trickle charge is occurring. As shown in FIG. 2, the green LED is activated by the microcontroller driving output LED 10N (86/SOA/XTAL) to high voltage.

Figure 3:
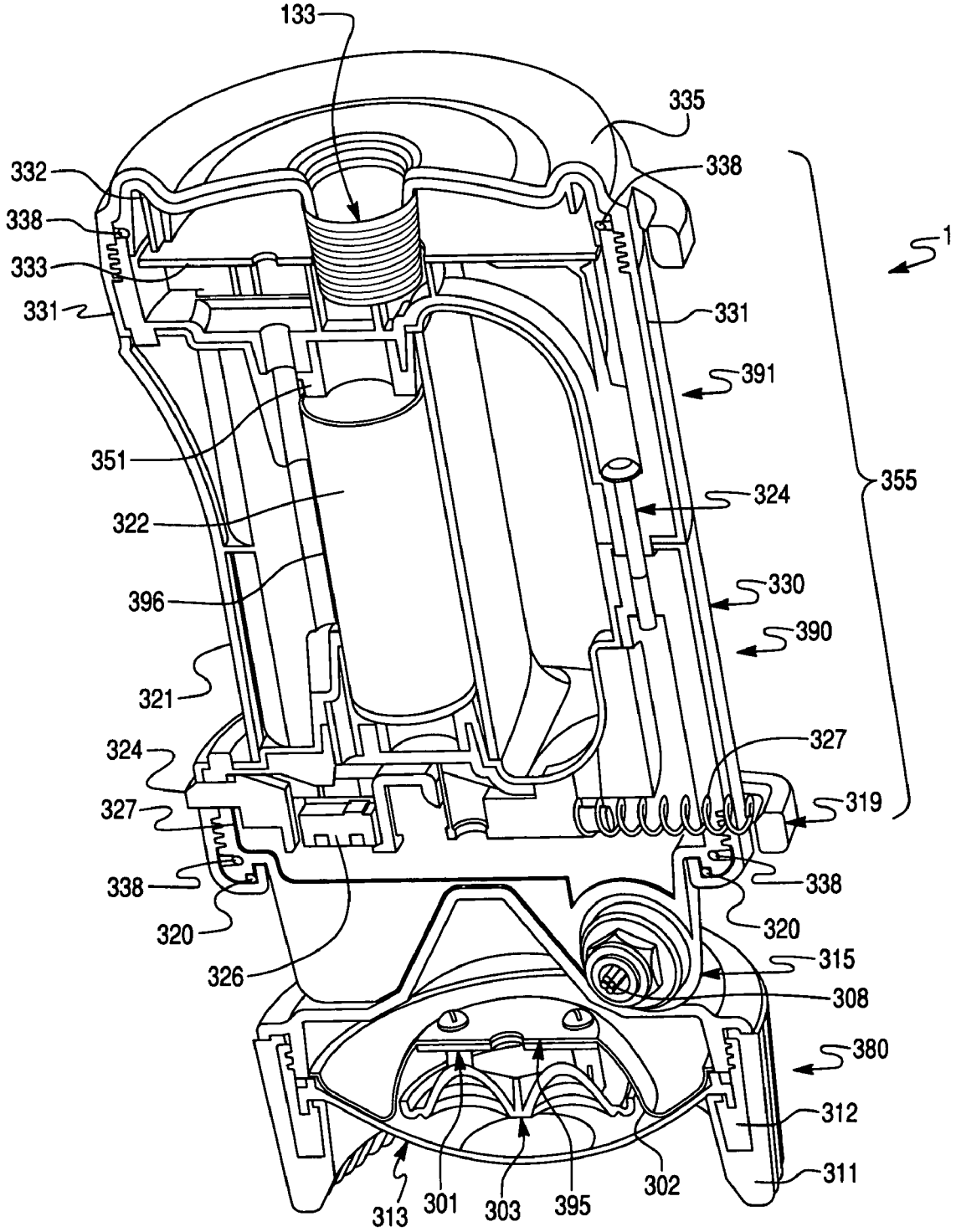
FIG. 3 is a cross sectional view of an embodiment of the lantern.

FIG. 3 shows a cross sectional view of an embodiment of the lantern 1. In the embodiment shown in FIG. 3, the lantern body is generally cylindrical in shape. At the bottom of the cylindrical shape is a vocational keying feature 370 that allows the lantern body to be dropped into the charging cradle 2 quickly and easily without the need to align anything other than the longitudinal axis of the lantern body. Thus, the body shape of the lantern 1 "self-keys" to the charger cradle 2 so as to securely lock the lantern body into position for efficient charging. This feature greatly improves user satisfaction and ensures proper alignment and positioning of the lantern and charging cradle induction coils.

The lantern's cylindrical shape also provides significant impact resistance and greatly improves the survivability of the lantern when dropped onto hard surfaces. The cylindrical shape further allows for mating parts to use threaded screw couplings for easy assembly. This feature eliminates the need for conventional fastener technology such as exposed metal fasteners, internal snap fits or adhesives, while allowing for easy disassembly for service. Additionally, the cylindrical shape allows for the use of off-the-shelf O-rings to provide sealing between mating parts against vapor, water and dirt intrusion.

As shown in FIG. 3, three main assemblies make up the lantern body. A light head assembly 380 contains the LEDs 395 mounted on printed circuit board 301 and wiring harness 308. A front main body assembly 390 and a rear main body assembly 391 are fastened together to contain the battery cell and to provide a handle by which a user can grip the lantern. Several methods may be used to fasten the front main body to the rear main body. In the embodiment shown in FIG. 3, screws 324 are be used to fasten the rear main body assembly 390 to the front main body assembly 391.

Contained within the light head assembly 380 is a printed circuit board assembly 301 containing the LEDs 395. The printed circuit board assembly 301 is connected to an LED heat sink 302 which dissipates heat generated by the LEDs 395 to prevent overheating. An LED reflector plate 303 is positioned behind the LEDs 395 to reflect light from the LEDs 395 and form a directed beam of light. A lens 313 is positioned over the LEDs 395 to protect the LEDs 395 from impact and sealed to protect them from the ambient environment. A lens ring 312 is placed over the lens to hold the lens 313 in place. The lens ring 312 may be fitted with threads to enable it to be tightly fastened to the lens 313 and hold the lens ring 312 in place. A hood 311 is fitted over the lens ring 312. The hood 311 keeps dust, dirt and other particulate matter from scratching the lens and/or covering the lens, which would diminish the light output of the lantern. When these pieces are in place and fastened, a watertight compression seal is created between the lens 313, lens ring 312 and hood 311. In this manner, the LEDs 395 are further shielded and isolated from the ambient environment. A rotator 315 is included to allow the user to rotate the light head assembly 380 both inline with axis of the lantern body and at 90 degrees off the axis of the lantern body. When engaged, light head assembly 380 rotates 90 degrees off the main axis of the lantern main body in a pivot hole located in the rotator 315. An O-ring creates a watertight seal between the lens housing and the rotator.

The light head/rotator assembly 380 is fastened to the front main body assembly 390 by threading the front collar 319 over the junction between the light head/rotator assembly 380 and the front main body assembly 390. O-rings 320 and 338 are placed within the front collar 319 to help to seal the lantern components, thereby isolating them from the ambient environment. The O-rings 320 and 338 create a watertight seal and allow rotation of the light head/rotator assembly, 350 degrees around with the axis of the lantern main body. The front collar remains stationary in the assembly.

A trigger 324 is located just behind the front collar 319. The trigger 324 has a pocket for the installation of electromechanical switch 326. The electromechanical switch 326 switches the power from the battery cell to the LEDs 395. A tongue is inserted from the exterior of the lantern, through a snap in the gasket, and into slots in the trigger 324. The tongue travels with the trigger when the trigger is actuated and is the mechanism that locks the lantern into the charger. The gasket creates a water tight seal for the tongue movement. The grip backup front is a rigid plastic part that the thermoplastic rubber grip front overmold is insert molded around. The grip backup front contains the threads that the front collar threads onto. The grip backup back is very similar to the grip backup front and is insert molded with the grip back overmold A trigger coil spring 327 is placed within the front main body portion and connected to the trigger 324. The trigger coil spring 327 allows a user to depress the trigger 324, thereby switching the lantern on and off, after which the spring returns the trigger 324 to its original position.

A grip front assembly 330 is created by overmolding the grip front overmold onto the grip backup front. The grip front assembly 330 provides half of the grip assembly 395. The other half of the grip assembly 331 is created when the rear main body assembly 391 is joined with the front main body assembly 390. Grip front assembly 330 is joined with grip back assembly 331 to create the overall user grip assembly 395. The grip assembly 395 may be provided with a soft, tactile gripping surface. Such a surface improves user satisfaction by reducing hand fatigue and increasing slip resistance when wet. The grip assembly also forms a watertight, flexible cover around the trigger 324. Common materials for the gripping surface including thermoplastic rubber.

Rechargeable battery cells 322 are contained within a chamber 396 created between the front main body assembly 390 and the rear main body assembly 391. The chamber 396 containing the rechargeable battery cells is a watertight compartment with watertight seals on all ends. A thermoplastic rubber stopper 351 compresses the batteries cells 322 within the chamber 396. The thermoplastic rubber stopper 351 cushions the battery cells 322 within the chamber 396 during an impact such as when the lantern is dropped. The secondary coil 133 is disposed in the center of the rear main body assembly 391. As discussed above with respect to FIGS. 1*a* and 1*d*, there is a second set of six LEDs 113 on the rear of the lantern which are selectively turned on by the microcontroller 103 to indicate a selected mode of operation. These six LEDs 113 are mounted on a printed circuit board 331 and covered by an end lens cap 332 to protect them from breakage and isolate them from the environment. A rear collar 335 secures the end lens cap 332 and the secondary coil 133, compressing an O-ring 338 to form a vapor and moisture tight seal.

Figure 4:
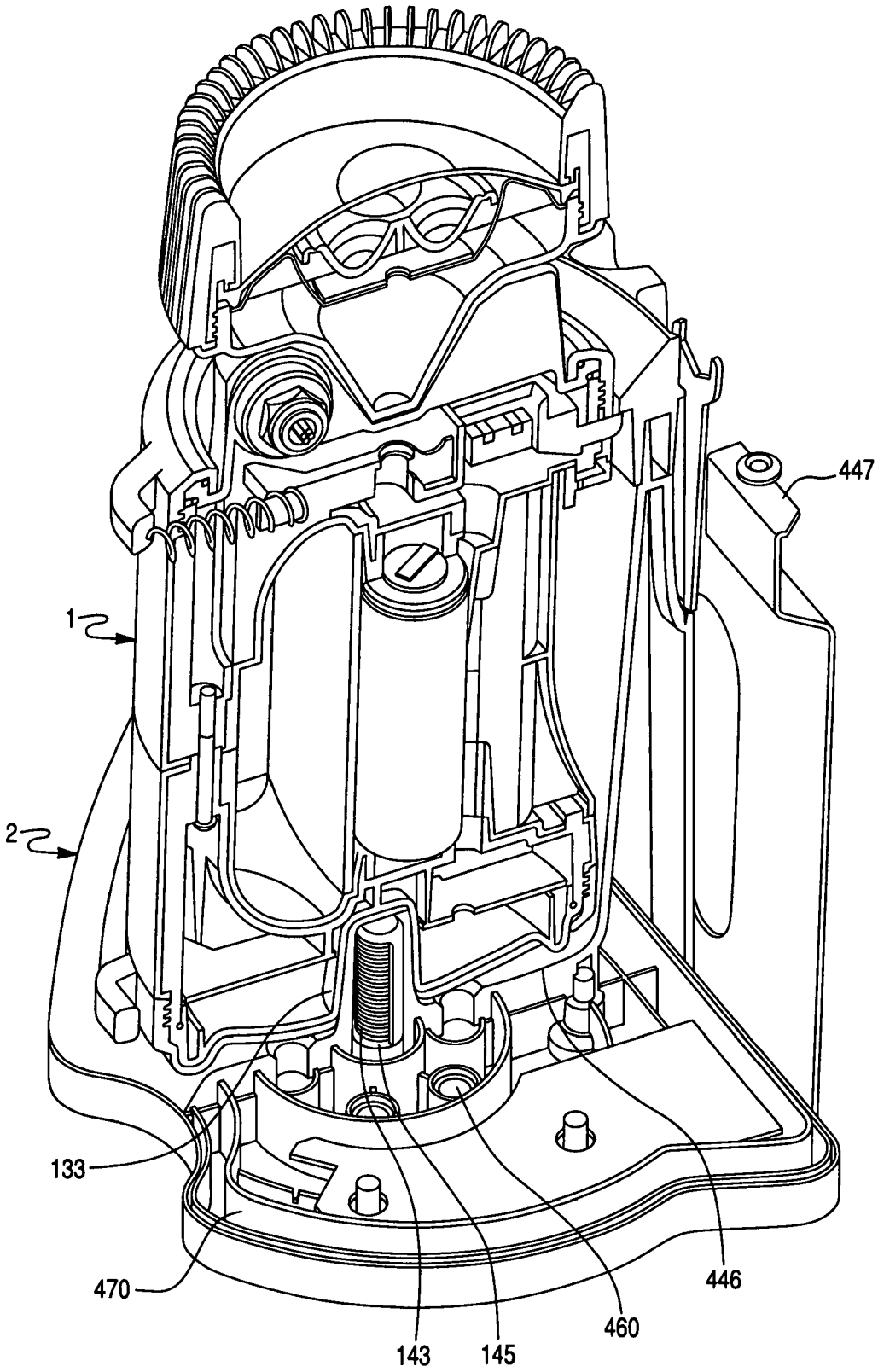
FIG. 4 is a cross sectional view of an embodiment of the lantern positioned within the charging cradle.

FIG. 4 depicts a cross-sectional view of the lantern 1 mated with the charging cradle 2. As shown in FIG. 4, the charging cradle and lantern interface design insures proper alignment of the primary charging coil 443 with the secondary coil 133. The charging cradle 2 comprises a charging cradle wall mount 447 and a charging cradle base 446. Through holes 460 are disposed in the charging cradle base 446 to allow the discharge of moisture (e.g., rain water) and for the circulation of air for cooling the lantern 1 while charging. The charging cradle base 446 is also designed with a gutter 470 that allows rain water to enter the charger and safely drain out without affecting the electronics. This gutter 470 eliminates the need for gaskets or adhesives.

Figure 5:
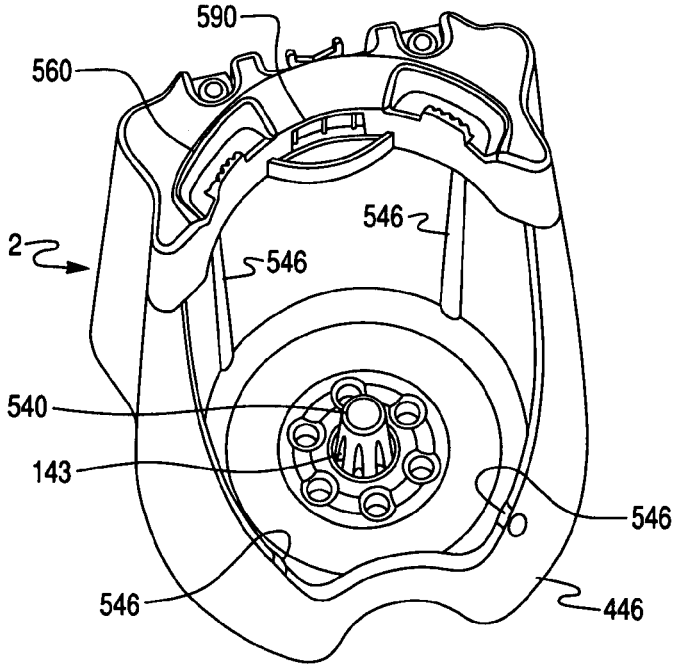
FIG. 5 is a top view of an embodiment of the charging cradle.

FIG. 5 provides a top view of the charging cradle 2. A charging post 540 is disposed in the center of the charging cradle base 446 such that proper alignment between the primary coil 443 surrounding the charging post 540 and the secondary coil disposed within the lantern. The charging cradle base 446 is also formed with protrusions 546. Charging cradle base protrusions 546 are formed to mate with corresponding cavities in the lantern body. The charging cradle base protrusions 546 insure that the lantern 1 is centered on the charging post 540. The charging cradle base protrusions further lock the bottom of the lantern 1 to the charger cradle 2 in the horizontal plane. The charging cradle 2 is further with standing ribs 560 which may be molded into the cradle body. The standing ribs 560 are formed and configured so as to engage pockets within the lantern collar feet 480. When engaged, the standing ribs 560 and lantern collar feet 480 lock the top of the lantern 1 to the charging cradle 2 in the horizontal plane. The charging cradle 2 is further configured to include slot 590. The slot 590 is formed to the engage trigger locking tab 495 on the lantern 1. thereby locking the lantern 1 in the charging cradle 2 in the vertical plane.

Figure 6:
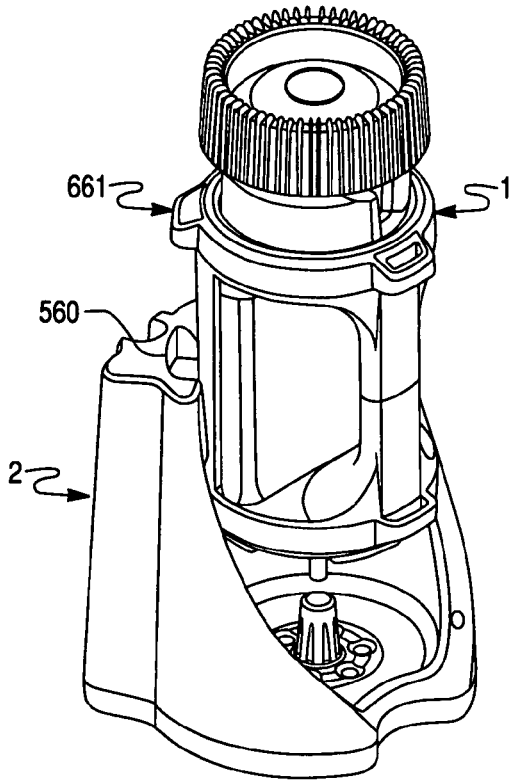
FIG. 6 illustrates an embodiment of the lantern in a drop in position with respect to an embodiment of the charging cradle.
Figure 7:
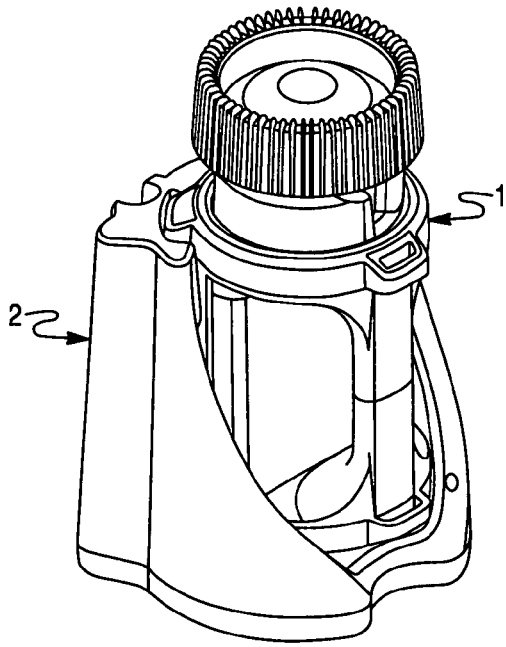
FIG. 7 illustrates an embodiment of the lantern in an installed charging position within an embodiment of the charging cradle.

FIG. 6 illustrates the lantern in the drop-in position. In this position, the lantern collar pockets 661 engage the standing ribs 560 on the charging cradle 2. FIG. 7 illustrates the lantern 1 in the installed position within the charging cradle 2.

Figure 8:
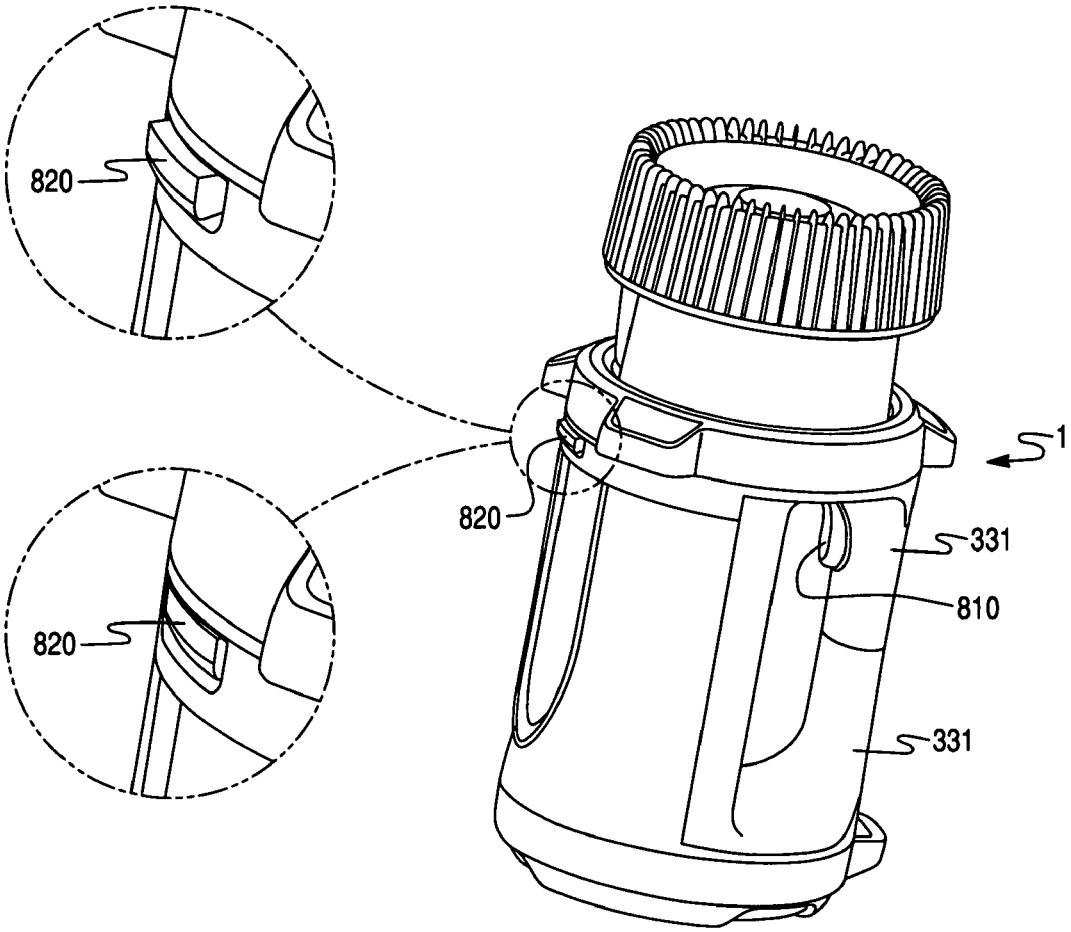
FIG. 8 provides an enlarged view of the trigger lock tab mechanism of an embodiment of the lantern.

FIG. 8 illustrates the operation of the lantern's squeeze trigger 810. The squeeze trigger 810 may be located under the user grip 330, 331. A user uses the squeeze trigger to operate the lantern, particularly turning the LED lights on and off. In addition, the squeeze trigger retracts the tongue to unlock the lantern from the charging cradle 2. The squeeze trigger 810 and tongue are spring loaded to automatically return to the locked position when released. The magnified views show the tongue in the locked and unlocked position. As shown, the tongue retract to an unlocked position. The spring loaded tongue 820 return to their extended position when the squeeze trigger 810 is released.

Figure 9:
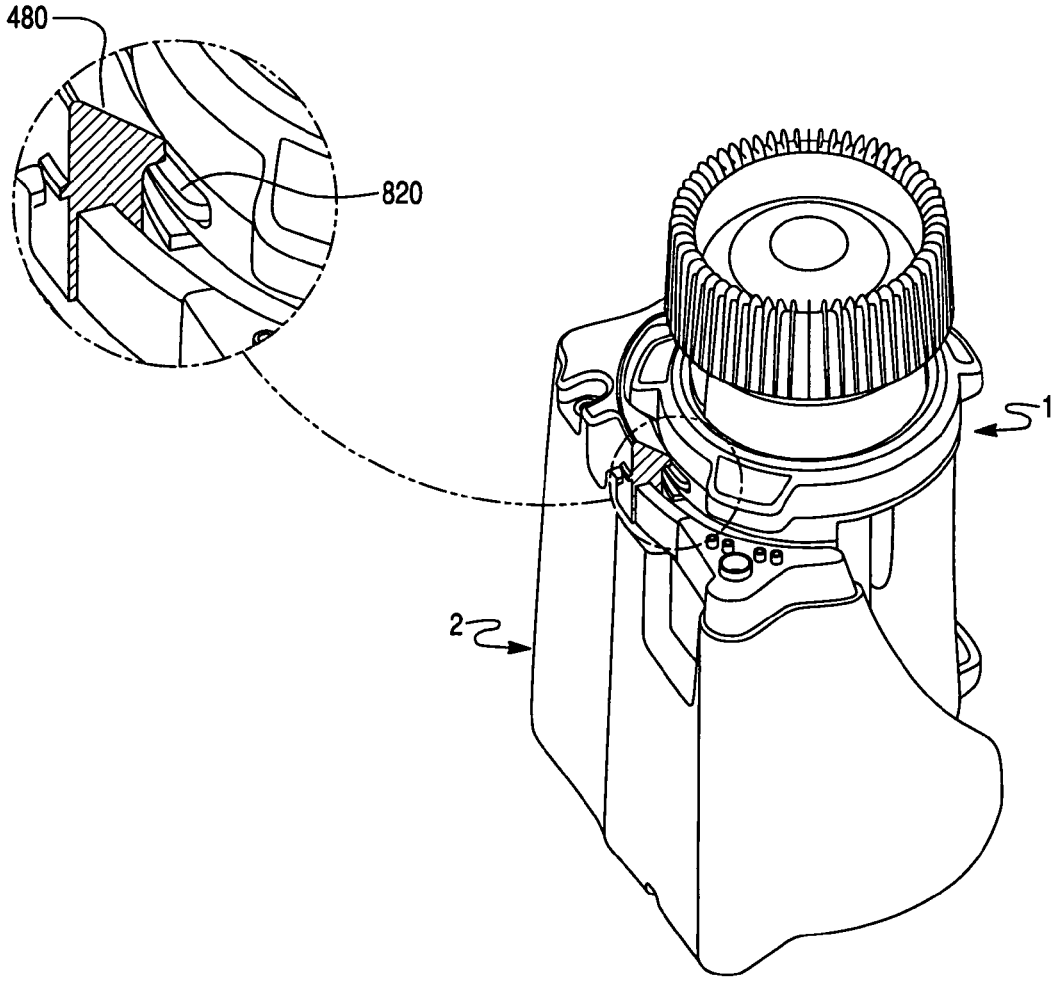
FIG. 9 provides an enlarged cut-away view of the trigger lock tab mechanism an embodiment of the lantern engaged with an embodiment of the charging cradle.

FIG. 9 provides an enlarged cut-away view of the tongue mechanism 820 engaged with the charging cradle 2. As the lantern 1 is lowered into the charging cradle 2 the tongue 820 rides on the angled face 480 of the charging locking slot 940 which forces the tongue 820 to retract. Once the tongue 820 moves past the angled face and under the charging locking slot 940 it returns to its extended locked position via a spring 327 inside the lantern 1. The magnified view illustrates the tongue 820 engaged and locked under the charging locking slot 940.

Figure 10:
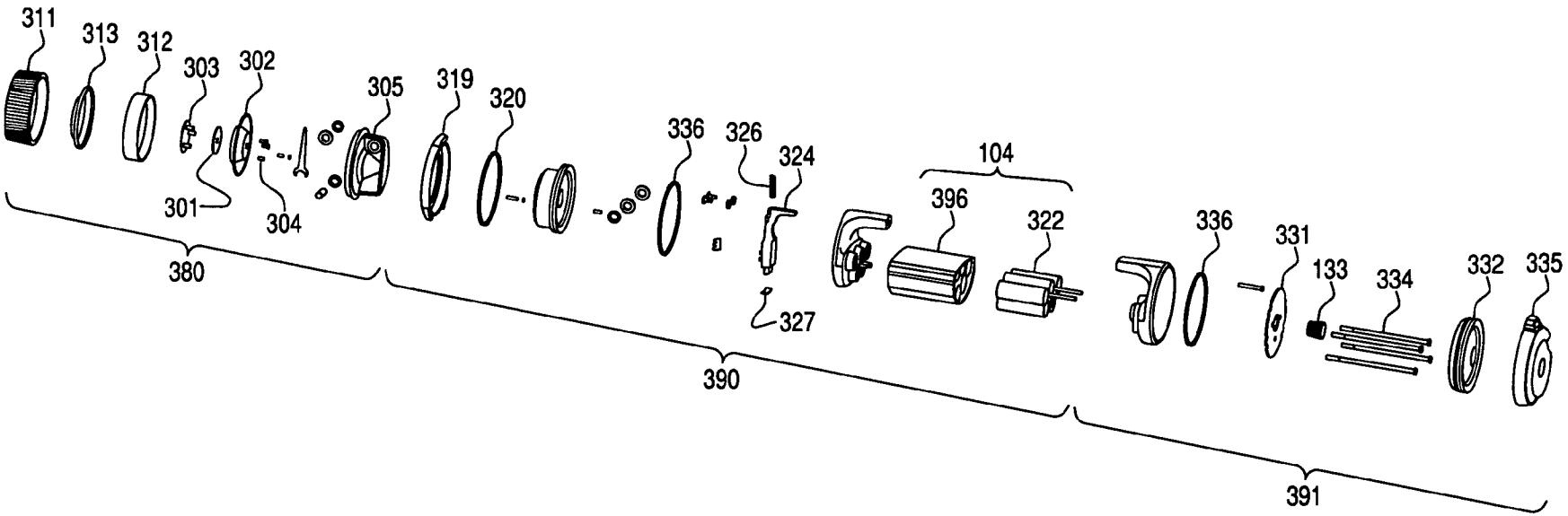
FIG. 10 provides an exploded view of an embodiment of the lantern.
Figure 11B:
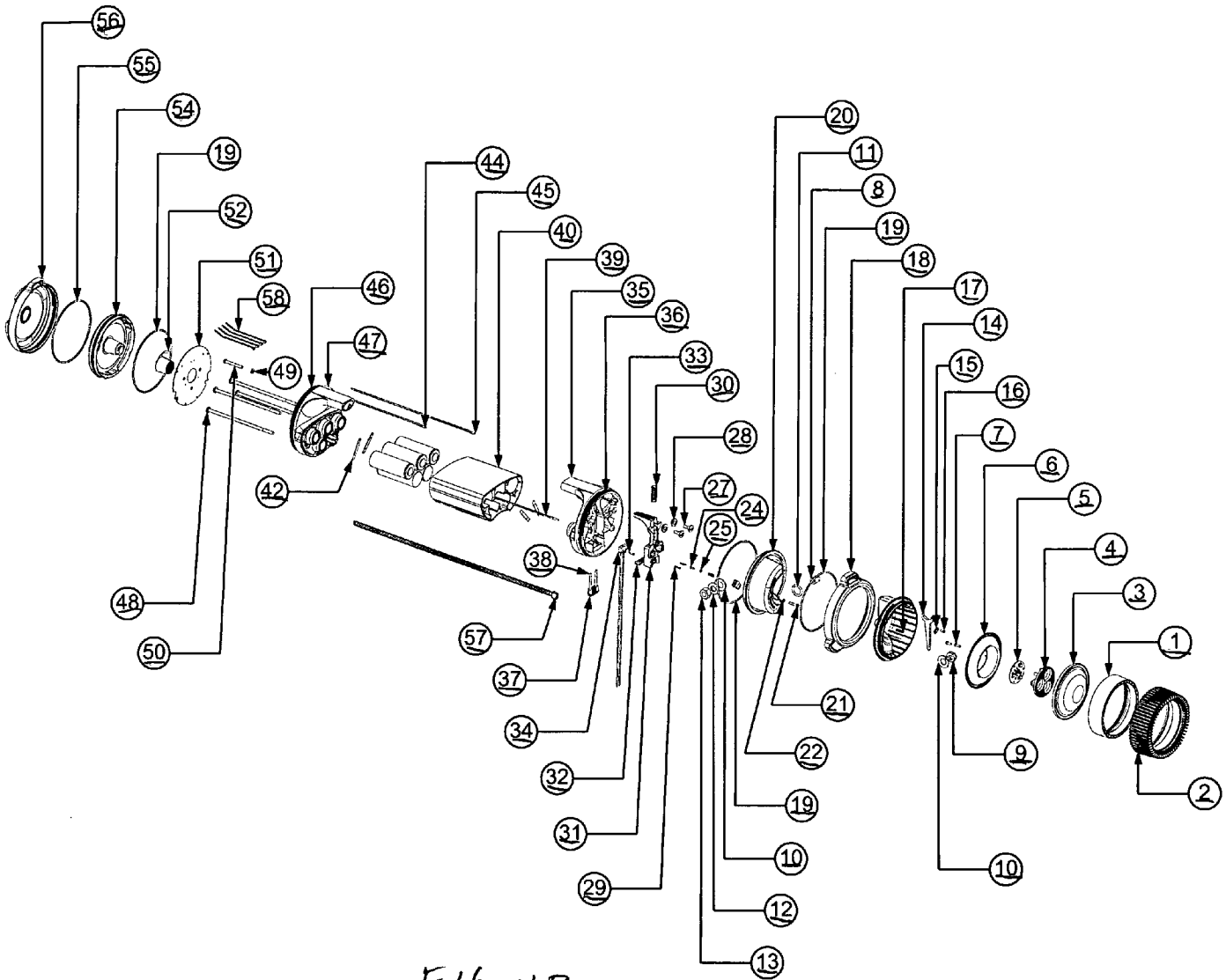
Figure 12B:
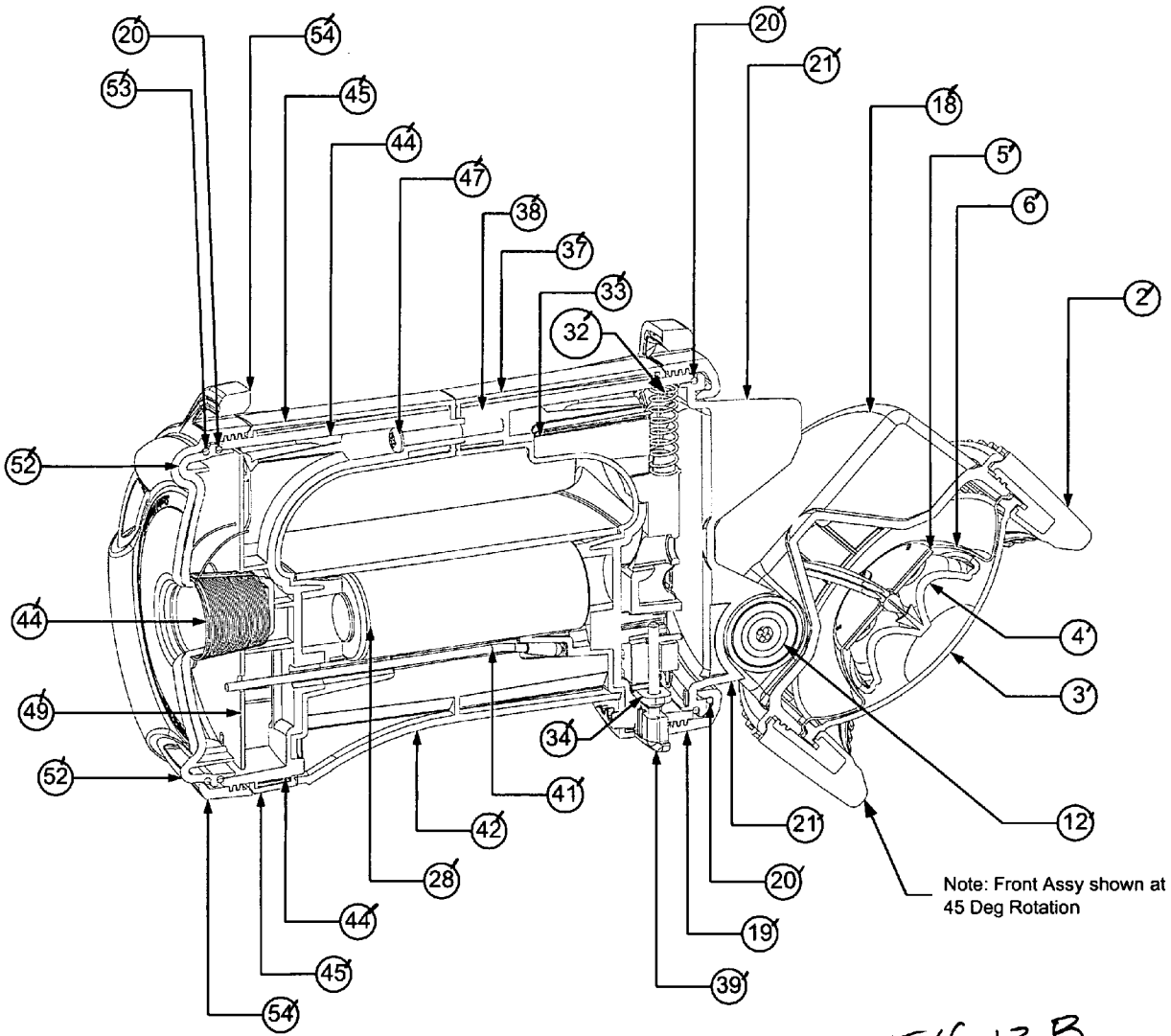

The foregoing description of the lantern assembly is further illustrated in FIG. 10 which provides an exploded view of the lantern components. As shown, a hood 311 engages the lens 313. The lens 313 is held in place by lens ring 312. The lens ring 312 contains the LED reflector 303 which is fastened to the printed circuit board assembly 301 and LED heat sink 302 using three self threading screws 304. The printed circuit board assembly 301 is connected to the wiring harness 305 located on lens housing 309. The hood 311, lens 313, lens ring 312, LED reflector 303, printed circuit board assembly 301, LED heat sink 302, wiring harness 305, and lens housing 309 comprise the light head assembly 380. A front collar 319 fastens the light head assembly 380 to the lantern body via threads integrally formed on front main body assembly 390. An O-ring 320 is fitted between the front collar 319 and rotator 315 to provide a watertight seal. A second O-ring 336 is disposed between the rotator 315 and the front main body assembly 390 to form a watertight seal between the rotator 315 and front main body assembly 390. The squeeze trigger 324 with spring 326 are constructed to fit within the front main body assembly 390. A tongue is assembled from outside of the lantern, thru holes in the grip backup front, thru a gasket, and finally into slots in the trigger 324. The tongue is fastened to the trigger. A battery cell compartment 396 containing the battery cells 322 is disposed between the front main body assembly 390 and rear main body assembly 391. A third O-ring 336 is disposed between the rear main body assembly 391 and the rear printed circuit board 331 to create another watertight seal between the rear main body assembly 390 and rear collar 335. The secondary coil 133 is placed within the center of the rear printed circuit board 331. Four self threading screws 334 fasten the rear printed circuit board 331 to the rear main body assembly 391 and the front main body assembly 390. A rear collar 335 is placed over an end cap lens 332 and fastened to the rear main body assembly 391 via threads integrally formed on the rear main body assembly 391. An O-ring 336 forms a watertight seal between the rear collar 335 and rear main body assembly 391.

Referring to FIGS. 11A through 12B, other forms of the lantern are shown along with the elements included.

While the present invention has been disclosed with reference to certain example embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

We claim:

1. A portable lantern, comprising:

at least one light emitting diode;

a rechargeable battery;

a secondary induction coil connected to the rechargeable battery and configured to provide charging current to the rechargeable battery;

at least three fault diodes connected between the rechargeable battery and ground; and at least one fuse and resistor array connected between the rechargeable battery and the light emitting diode.

2. The portable lantern of claim 1, comprising three light emitting diodes.

3. The portable lantern of claim 1, wherein the rechargeable battery comprises a nickel metal hydride (NiMH) cell.

4. The portable lantern of claim 3, wherein the rechargeable battery comprises five NiMH battery cells electrically connected in series.

5. The portable lantern of claim 1, further comprising a fuse and a resistor array connected between the rechargeable battery and one of the at least one light emitting diodes.

6. The portable lantern of claim 5, wherein each resistor array is configured to limit current flow to the one of the at least one light emitting diodes in the event of a fault condition.

7. The portable lantern of claim 5, further comprising a closed loop current control circuit coupled to one resistor array and to one light emitting diode, wherein the resistor array is configured and connected so that a voltage across the resistor array is provided as an input to the closed loop current control circuit, and the closed loop current control circuit is configured to regulate current flowing to the one light emitting diode.

8. The portable lantern of claim 1, further comprising a first thermistor disposed to sense a temperature of the battery;

a second thermistor disposed to sense an ambient temperature; and a microcontroller coupled to the first and second thermistor and to a transistor coupled between the second induction coil and the battery, wherein the microcontroller is adapted and configured to regulate battery charging based in part upon signals received from the first and second thermistor by turning the transistor on or off.

9. The portable lantern of claim 8, wherein the microcontroller is further adapted and configured to regulate battery charging based upon a measured rate of temperature increase as indicated in the signal received from the first thermistor.

10. The portable lantern of claim 9, wherein the microcontroller is further adapted and configured to terminate battery charging if the signal from the first thermistor has a value indicating the battery is near a predetermined temperature.

11. The portable lantern of claim 9, wherein the microcontroller is further adapted and configured to terminate battery charging after a predetermined time has elapsed.

12. A portable rechargeable lantern system, comprising:

a lantern comprising:

at least one light emitting diode;

a rechargeable battery;

a secondary induction coil connected to the rechargeable battery to provide charging current to the rechargeable battery;

at least three fault diodes connected between the rechargeable battery and ground; and at least one fuse and resistor array connected between the rechargeable battery and the at least one light emitting diode; and a charging cradle comprising:

a power source;

a charging post; and a primary induction coil disposed within the charging post and electrically connected to the power source.

13. The portable rechargeable lantern system of claim 12 wherein:

the portable lantern further comprises a lantern light head assembly and a lantern main body assembly, said lantern main body assembly having cavities and collar feet molded into the main body assembly, and the charging cradle further comprises protrusions integrally molded within the charging cradle configured to mate with the cavities molded into the lantern main body assembly.

14. The portable rechargeable lantern system claim 13 wherein the charging cradle further comprises a charging cradle base having holes disposed in the charging cradle base to allow discharge of water and circulation of air to cool the lantern during charging.

15. The portable rechargeable lantern system claim 14 wherein the charging cradle further comprises a gutter configured to allow water to enter the charging cradle and drain out away from the lantern.

16. The portable rechargeable lantern system claim 13 wherein the charging cradle further comprises standing ribs integrally formed to mate with the collar feet molded into the lantern main body assembly.

17. The portable rechargeable lantern system claim 12 wherein the lantern further comprising a squeeze trigger which when engaged retracts a spring loaded trigger locking tab.

18. The portable rechargeable lantern system claim 17 where the charging cradle further comprises trigger locking slots adapted to mate with the trigger locking tab to secure the lantern in the charging cradle.

19. The portable rechargeable lantern system claim 18, comprising three light emitting diodes.

20. The portable rechargeable lantern system claim 18, wherein the rechargeable battery comprises a nickel metal hydride (NiMH) cell.

21. The portable rechargeable lantern system claim 20, wherein the rechargeable battery comprises five NiMH battery cells electrically connected in series.

22. The portable rechargeable lantern system claim 18, further comprising a fuse and a resistor array connected between the rechargeable battery and one of the at least one light emitting diodes.

23. The portable rechargeable lantern system claim 22, wherein each resistor array is configured to limit current flow to the on of the at least one light emitting diodes in the event of a fault condition.

24. The portable rechargeable lantern system claim 22, further comprising a closed loop current control circuit coupled to one resistor array and to one light emitting diode, wherein resistor array is configured and connected so that a voltage across the resistor array is provided as an input to the closed loop current control circuit, and the closed loop current control circuit is configured to regulate current flowing to the one light emitting diode.

25. The portable rechargeable lantern system claim 18, further comprising a first thermistor disposed to sense a temperature of the battery;

a second thermistor disposed to sense an ambient temperature; and a microcontroller coupled to the first and second thermistor and to a transistor coupled between the second induction coil and the battery, wherein the microcontroller is adapted and configured to regulate battery charging based in part upon signals received from the first and second thermistor by turning the transistor on or off.

26. The portable rechargeable lantern system claim 25, wherein the microcontroller is further adapted and configured to regulate battery charging based upon a measured rate of temperature increase as indicated in the signal received from the first thermistor.

27. The portable rechargeable lantern system claim 26, wherein the microcontroller is further adapted and configured to terminate battery charging if the signal from the first thermistor has a value indicating the battery is near a predetermined temperature.

28. The portable rechargeable lantern system claim 26, wherein the microcontroller is further adapted and configured to terminate battery charging after a predetermined time has elapsed.

* * * * *